US006375433B1

(12) United States Patent
Du et al.

(10) Patent No.: US 6,375,433 B1
(45) Date of Patent: Apr. 23, 2002

(54) METHOD AND APPARATUS FOR CONTROLLING PUMP DISCHARGE PRESSURE OF A VARIABLE DISPLACEMENT HYDRAULIC PUMP

(75) Inventors: Hongliu Du, Dunlap; Noah D. Manring, Chillicothe, both of IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/611,387

(22) Filed: Jul. 7, 2000

(51) Int. Cl.[7] ..... F04B 49/00
(52) U.S. Cl. ..... 417/53; 417/212; 417/222.1
(58) Field of Search ..... 417/53, 212, 217, 417/218, 222.2, 222.1

(56) References Cited

U.S. PATENT DOCUMENTS 4,139,987 A 2/1979 Budzich
4,510,750 A 4/1985 Izumi et al.
5,588,805 A 12/1996 Geringer
5,666,806 A * 9/1997 Dietz ..... 60/327
5,865,602 A 2/1999 Nozari

* cited by examiner

*Primary Examiner*—Cheryl J. Tyler
(74) *Attorney, Agent, or Firm*—Steve D. Lundquist

(57) ABSTRACT

A method and apparatus for controlling a pump discharge pressure of a variable displacement hydraulic pump having a swashplate, and a servo valve for controlling an angle of inclination of the swashplate. The method and apparatus includes sensing a value of an actual pump discharge pressure, determining a desired control pressure using a first feedback linearization control law, determining a desired servo valve spool position using a second feedback linearization control law, and controlling the value of the actual pump discharge pressure as a function of the first and second feedback linearization control laws.

13 Claims, 6 Drawing Sheets

METHOD AND APPARATUS FOR CONTROLLING PUMP DISCHARGE PRESSURE OF A VARIABLE DISPLACEMENT HYDRAULIC PUMP

TECHNICAL FIELD

This invention relates generally to a method and apparatus for controlling a variable displacement hydraulic pump and, more particularly, to a method and apparatus for controlling nonlinear characteristics associated with the pump discharge pressure of a variable displacement pump.

BACKGROUND ART

Variable displacement hydraulic pumps are used in a variety of applications. For example, hydraulic construction machines, earthworking machines, and the like, often use variable displacement hydraulic pumps to provide the pressurized hydraulic fluid flow required to perform desired work functions.

Operation of the pumps, however, is subject to variations in pressure and flow output caused by variations in load requirements. It has long been desired to maintain the pressure output of the pumps in a consistent manner so that operation of the hydraulic systems is well behaved and predictable. Therefore, attempts have been made to monitor the pressure output of a pump, and control pump operation accordingly to compensate for changes in loading.

For example, U.S. Pat. Nos. 4,510,750 and 5,865,602, to Izumi et al. and Nozari, respectively, disclose the use of feedback systems which monitor characteristics such as pump output pressure, and provide feedback control of the pump in attempts to operate the pump in a desired manner. However, neither Izumi et al. nor Nozari account for the wide range of nonlinearities inherent in hydraulic pump operation. The disclosed patents of Izumi et al. and Nozari are limited to a linear range of pump operation in which behavior of the pump is fairly predictable and thus may be controlled using well known linear control techniques.

Nonlinear control methods exist which may be used to control systems having essentially nonlinear behavior, such as variable displacement pumps. For example, one of the most common methods of control is to first linearize a nonlinear system and then control the resultant linear system. A common example of such a system involves a Taylor Series linearization, which linearizes a small portion of the system about an operating point, the portion being essentially linear in nature to begin with. The drawback of a method such as this is that predictable performance is only assured if the system stays close to the particular point about which it is linearized.

Another method is to use a technique commonly known as gain scheduling, in which a series of operating points are selected, then a small portion about each operating point is linearized, e.g., by a method such as the Taylor Series. However, this results in a discrete system which does not function well as the system moves from one operating point to another.

A method known as feedback linearization may be used to transform nonlinear dynamics of a system to linear equations, which may then be used to control the system in an effective manner. For example, in U.S. Pat. No. 5,666,806, Dietz discloses a system which uses feedback linearization control laws to control the nonlinear behavior of a hydraulic system, in particular the nonlinear behavior of a hydraulic cylinder. However, the system disclosed by Dietz incorporates nonlinearities from multiple sources, such as a pump, cylinder, control valve, and the like. As a result, Dietz is required to apply feedback linearization control laws to many sources of nonlinearities, thus resulting in linearized equations having multiple, i.e., fourth order, dynamic response characteristics.

In the present invention, it is desired to control a single device, i.e., a variable displacement hydraulic pump, within a hydraulic system, and thus control the nonlinear characteristics associated with the hydraulic pump. It is also desired to control the pump using feedback linearization control laws to control the discharge pressure of the pump over a wide range of nonlinear operating conditions. Furthermore, it is desired to control the nonlinear characteristics of the pump using feedback linearization control laws which create a first order system tracking response, thus providing control over nonlinearities without overshoot for step response.

The present invention is directed to overcoming one or more of the problems as set forth above.

DISCLOSURE OF THE INVENTION

In one aspect of the present invention a method for controlling a pump discharge pressure of a variable displacement hydraulic pump having a swashplate, and a servo valve for controlling an angle of inclination of the swashplate, is disclosed. The method includes the steps of sensing a value of an actual pump discharge pressure, determining a desired control pressure using a first feedback linearization control law, determining a desired servo valve spool position using a second feedback linearization control law, and controlling the value of the actual pump discharge pressure as a function of the first and second feedback linearization control laws.

In another aspect of the present invention an apparatus for controlling a pump discharge pressure of a variable displacement hydraulic pump is disclosed. The apparatus includes a swashplate inclinably mounted to the pump, a servo valve hydraulically connected to the pump for controlling an angle of inclination of the swashplate, a pump discharge pressure sensor connected to an output port of the pump, and a controller electrically connected to the pump for sensing a value of an actual pump discharge pressure, determining a desired control pressure using a first feedback linearization control law, determining a desired servo valve spool position using a second feedback linearization control law, and controlling the value of the actual pump discharge pressure as a function of the first and second feedback linearization control laws.

BEST MODE FOR CARRYING OUT THE INVENTION

Figure 1:
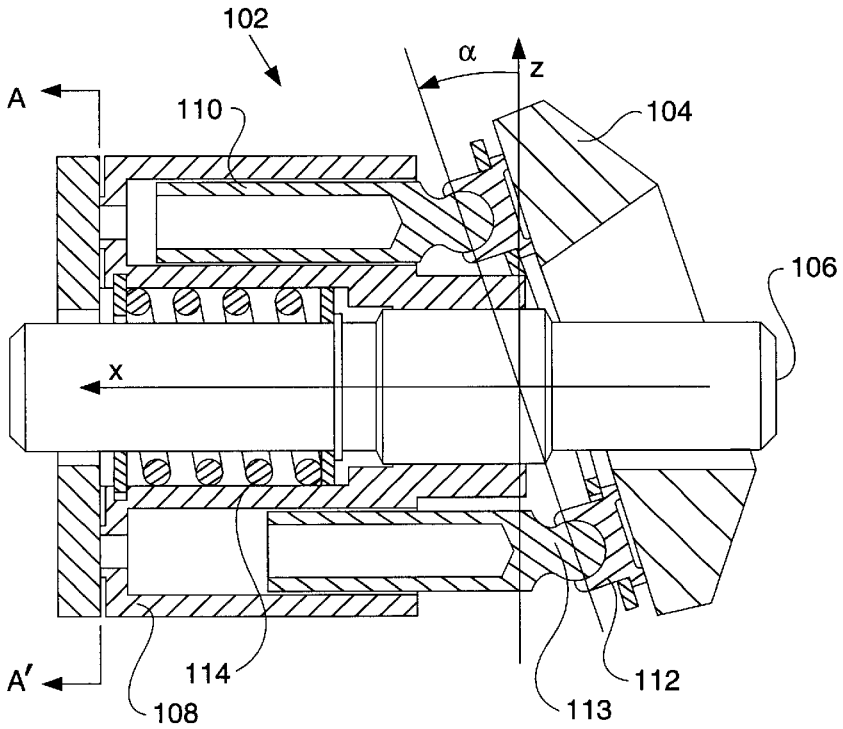
FIG. 1 is a diagrammatic side profile cutaway view of a variable displacement hydraulic pump suitable for use with the present invention.

Referring to the drawings, a method and apparatus 100 for controlling a pump discharge pressure of a variable displacement hydraulic pump 102 is disclosed.

Figure 2:
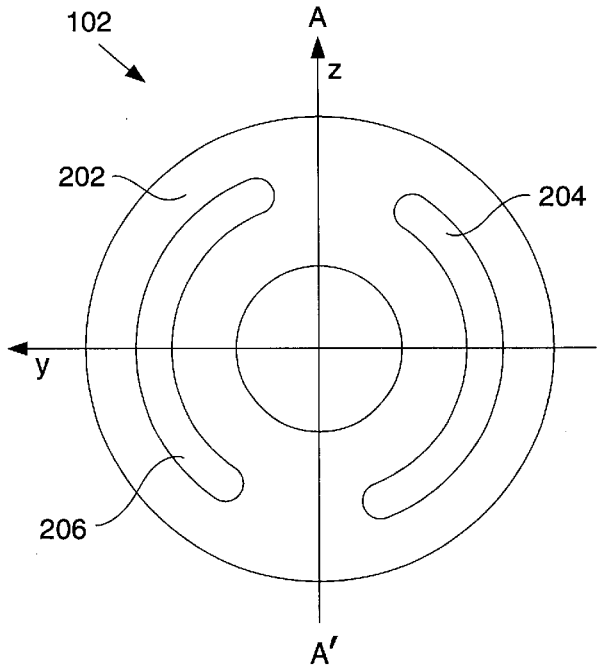
FIG. 2 is a diagrammatic end view of the pump of FIG. 1.

With particular reference to FIGS. 1 and 2, the variable displacement hydraulic pump 102, hereinafter referred to as pump 102, is preferably an axial piston swashplate hydraulic pump 102 having a plurality of pistons 110, e.g., nine, located in a circular array within a cylinder block 108. Preferably, the pistons 110 are spaced at equal intervals about a shaft 106, located at a longitudinal center axis of the block 108. The cylinder block 108 is compressed tightly against a valve plate 202 by means of a cylinder block spring 114. The valve plate includes an intake port 204 and a discharge port 206.

Each piston 110 is connected to a slipper 112, preferably by means of a ball and socket joint 113. Each slipper 112 is maintained in contact with a swashplate 104. The swashplate 104 is inclinably mounted to the pump 102, the angle of inclination $\alpha$ being controllably adjustable.

Figure 3:
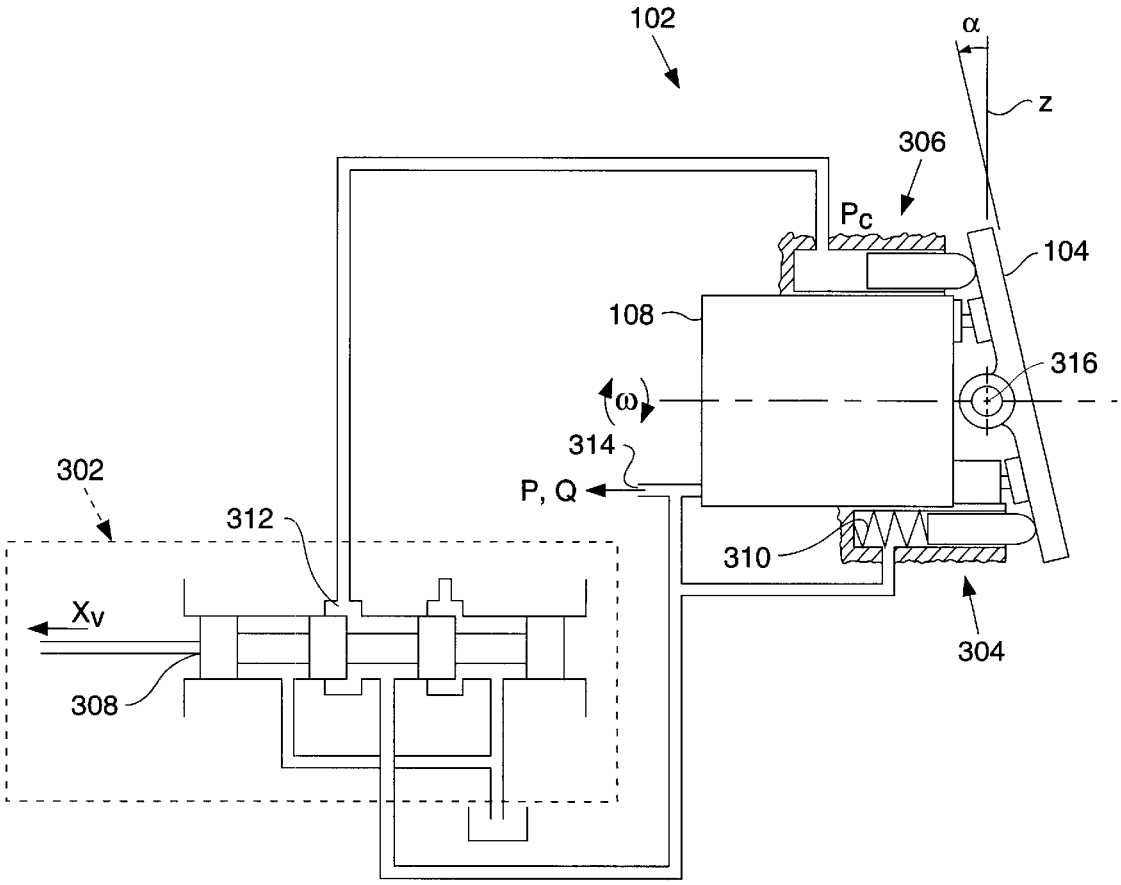
FIG. 3 is a diagrammatic illustration of a pump including a servo valve.

With continued reference to FIGS. 1 and 2, and with reference to FIG. 3, operation of the pump 102 is illustrated. The cylinder block 108 rotates at a constant angular velocity $\omega$. As a result, each piston 110 periodically passes over each of the intake and discharge ports 204, 206 of the valve plate 202. The angle of inclination $\alpha$ of the swashplate 104 causes the pistons 110 to undergo an oscillatory displacement in and out of the cylinder block 108, thus drawing hydraulic fluid into the intake port 204, which is a low pressure port, and out of the discharge port 206, which is a high pressure port.

In the preferred embodiment, the angle of inclination $\alpha$ of the swashplate 104 inclines about a swashplate pivot point 316 and is controlled by a servo valve 302. A servo valve spool 308 is controllably moved in position within the servo valve 302 to control hydraulic fluid flow at an output port 312 of the servo valve 302. A discharge pressure feedback servo 304, in cooperation with a servo spring 310, operates to increase the angle of inclination $\alpha$ of the swashplate 104, thus increasing the stroke of the pump 102. A control servo 306, receives pressurized fluid from the output port 312 of the servo valve 302, and responsively operates to decrease the angle of inclination $\alpha$ of the swashplate 104, thus decreasing the stroke of the pump 102. Preferably, the control servo 306 is larger in size and capacity than the discharge pressure feedback servo 304. The pump 102 provides pressurized hydraulic fluid to the discharge port 206 of the valve plate 202 by means of a pump output port 314.

Figure 4:
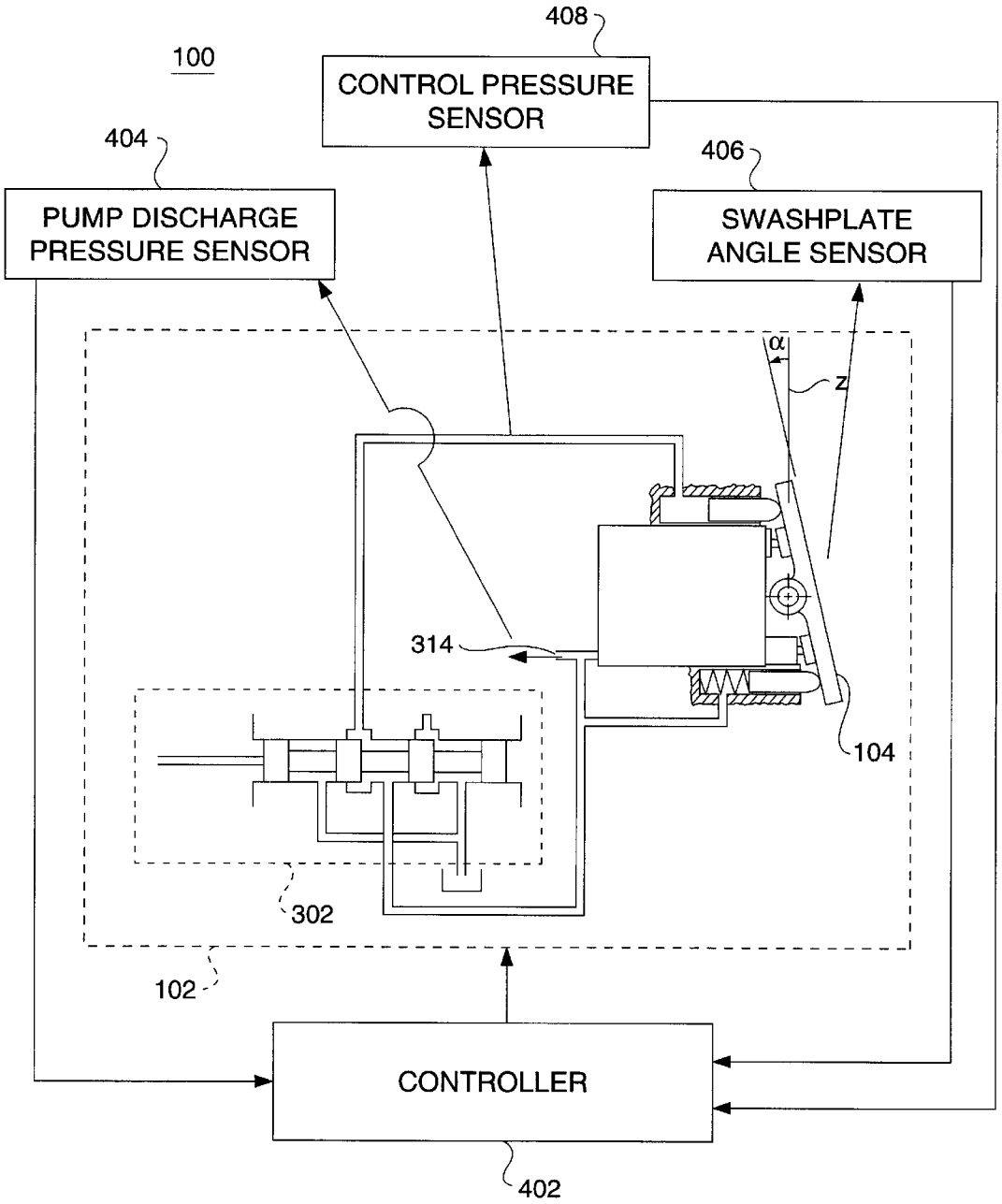
FIG. 4 is a block diagram illustrating a preferred apparatus including a control system for the pump of FIG. 3.

Referring to FIG. 4, a block diagram illustrating a preferred embodiment of the present invention is shown.

A pump discharge pressure sensor 404, preferably located at the pump output port 314, is adapted to sense the output pressure of the hydraulic fluid from the pump 102. Alternatively, the pump output pressure sensor 404 may be located at any position suitable for sensing the pressure of the fluid from the pump 102, such as at the discharge port 206 of the valve plate 202, at a point along the hydraulic fluid line from the pump 102 to the hydraulic system being supplied with pressurized fluid, and the like. In the preferred embodiment, the pump discharge pressure sensor 404 is of a type well known in the art and suited for sensing pressure of hydraulic fluid.

A control pressure sensor 408 is located at the control servo 306 in a manner suitable for sensing the pressure of the hydraulic fluid being provided to the control servo 306 by the servo valve 302. Alternatively, the control pressure sensor 408 may be located at the servo valve output port 312.

An optional swashplate angle sensor 406 is located at the swashplate 104 in a manner suitable for sensing the angle of inclination $\alpha$ of the swashplate 104. For example, the swashplate angle sensor 406 may be a resolver mounted to the swashplate 104, a strain gauge attached to the swashplate 104, or some other type of sensor well known in the art. As discussed in more detail below, the swashplate angle sensor 406 may not be required with the present invention under certain circumstances.

A controller 402, preferably located on a machine (not shown) which uses the pump 102 as part of an overall hydraulic system, for example a mobile construction or earthworking machine, and electrically connected to the pump 102, is adapted to receive the sensed information from the pump discharge pressure sensor 404, the swashplate angle sensor 406, and any other sensors required, and responsively perform a series of functions intended to control the value of the hydraulic discharge pressure of the pump 102 in a desired manner. More specifically, the controller 402 is adapted to determine a desired pump discharge pressure using a first feedback linearization control law, determine a desired servo valve spool position using a second feedback linearization control law, and control the value of the actual pump discharge pressure as a function of the first and second feedback linearization control laws. The operation of the controller is discussed in more detail below.

Figure 5:
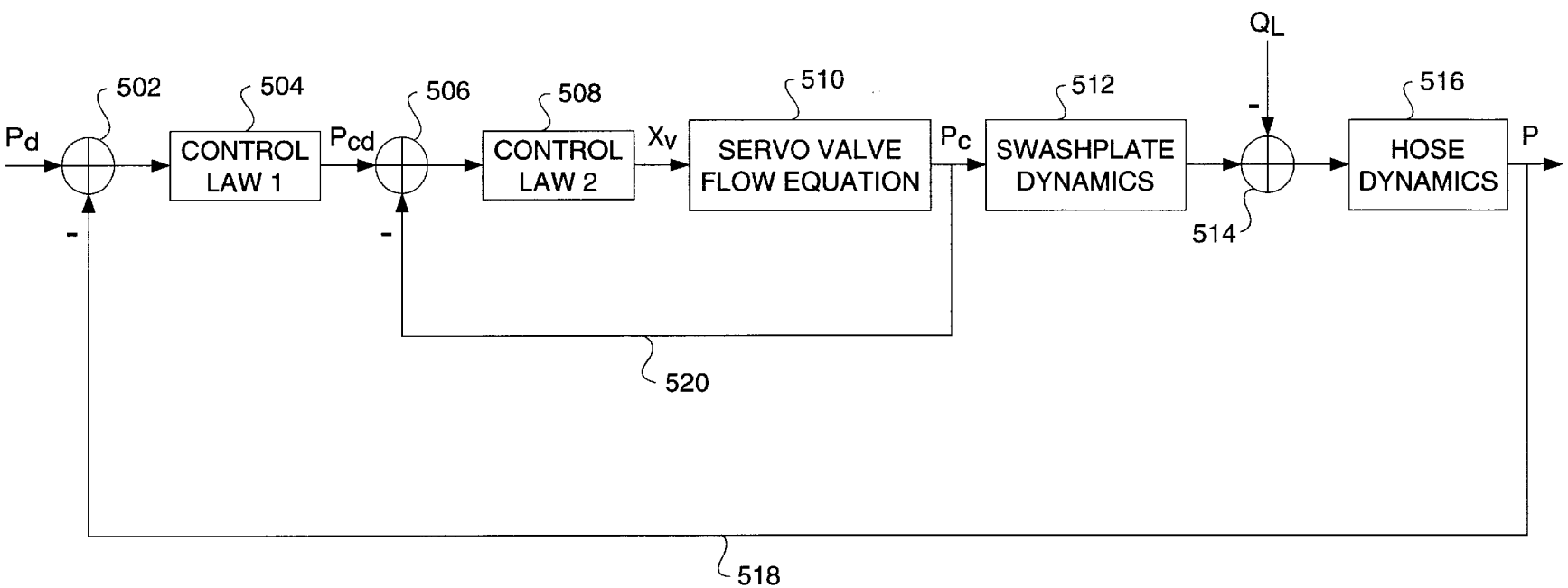
FIG. 5 is a feedback control diagram for the control system of FIG. 4.

Referring to FIG. 5, a feedback control diagram representative of a preferred embodiment of the present invention is shown.

A desired pump discharge pressure $P_d$ is input into a first junction 502, which also receives feedback from the output pressure P of the pump.

The output of the first junction is provided to a first feedback linearization control law 504 to determine a desired control pressure $P_{cd}$. Feedback linearization control laws, which in theory are well known in the art, are used to transform a nonlinear system to a global linear system.

In the preferred embodiment, the first feedback linearization control law 504 is used for an outer loop 518 of the feedback control system and may be represented by an exemplary equation of the form:

$$P_{cd} = \frac{1}{a_c}\left(a_p P_d - d + I(\alpha)\ddot{\alpha} + G(\alpha, \dot{\alpha}) - \Delta\dot{P} - k_c \Delta P\right) \quad \text{(Eq. 1)}$$

where

- $a_c$ is the cross-section area of the control servo 306 multiplied by the distance from the control servo 306 to the swashplate pivot point 316;
- $a_p$ is the cross-section area of the discharge pressure feedback servo 304 multiplied by the distance from the discharge pressure feedback servo 304 to the swashplate pivot point 316, which is added to a term representative of a swashplate pressure carry-over angle $\gamma$ (which is described in more detail below with reference to FIG. 7);
- d is a spring bias term for the servo spring 310;
- $I(\alpha)\alpha+G(\alpha\dot{\alpha})$ are nonlinear dynamics of the swashplate 104; and
- $\Delta\dot{P}-k_c\Delta P$ are error dynamics terms, where $k_c$ is a gain constant which is greater than zero, and $\Delta P$ represents the difference between the actual discharge pressure of the pump 102 and the desired discharge pressure of the pump 102.

This input will result in a stable, convergent, first-order dynamic output governed by the equation:

$$\Delta\dot{P}-k_c\Delta P=0 \quad \text{(Eq. 2)}$$

where, as Eq. 2 approaches zero, overshoot of the pump discharge pressure P is eliminated.

It is noted that Eq. 1 is representative of an exemplary first feedback linearization control law 504, and that variations of the control law 504 may be used without deviating from the scope of the present invention.

A second junction 506 receives the desired control pressure $P_{cd}$ and also receives feedback from an inner loop 520. The resultant output is then delivered to a second feedback linearization control law 508, which is used to determine a desired servo valve spool position $x_v$. The second feedback linearization control law 508 may be represented by an exemplary equation of the form:

$$x_v = \frac{C_{lc}P_c - a_c\dot{\alpha} - \left(\frac{V_c}{\beta}\right)\left(k_x\Delta P_c - \dot{P}_{cd}\right)}{C_d w\sqrt{\frac{P+sgn(x_v)P}{2} - sgn(x_v)P_c}} \quad \text{(Eq. 3)}$$

where $C_{1c}$ is a leakage coefficient of the control servo 306;

$P_c$ is the control pressure, i.e., pressure applied to the control servo 306;

$\dot{\alpha}$ is an angular velocity of the swashplate 104;

$$\frac{V_c}{\beta}$$

is a capacitance of the control servo 306;

$k_x\Delta P_c-\dot{P}_{cd}$ are control servo error dynamics terms, where $k_x$ is a gain constant that is greater than zero;

$C_d$ is a valve orifice coefficient for the,,servo valve spool; and w is the area rate which can be obtained by evaluating the derivative of the area of the valve orifice at zero position.

Referring to the control servo error dynamics, $k_x\Delta P_c-\dot{P}_{cd}$, $\Delta P_c=P_c-P_{cd}$. The resultant system error dynamics for the inner loop 520 are given by:

$$\Delta\dot{P}_c+k_x\Delta P_c=0 \quad \text{(Eq. 4)}$$

where, as Eq. 4 approaches zero, overshoot of the control servo control pressure $P_c$ is eliminated.

It is noted that Eq. 2 is representative of an exemplary second feedback linearization control law 508, and that variations of the control law 508 may be used without deviating from the scope of the present invention.

The output from the second feedback linearization control law 508 is then delivered to a servo valve flow equation 510, to determine the control pressure $P_c$. Preferably, the servo valve flow equation 510 is used to determine $P_c$ by first determining the flow rate $Q_c$ controlled by the servo valve 302. An exemplary equation to determine $Q_c$ is:

$$Q_c = C_d A_o(x_v)\sqrt{\frac{2}{\rho}\left(\frac{P+sgn(x_v)P}{2} - sgn(x_v)P_c\right)} \quad \text{(Eq. 5)}$$

where $A_o(x_v)$ is the orifice area.

The control pressure $P_c$ is then compensated for various swashplate dynamics 512, such as nonlinear friction on the swashplate 104, Coulomb friction between each piston 110 and the cylinder block 108, and the like. The output from the compensation for the swashplate dynamics is then delivered to a third junction 514, in which the actual load flow rate $Q_L$ is combined. The output from the third junction 514 is then compensated for hose dynamics 516, such as compressibility of the hydraulic fluid, leakage, and the like.

Figure 6:
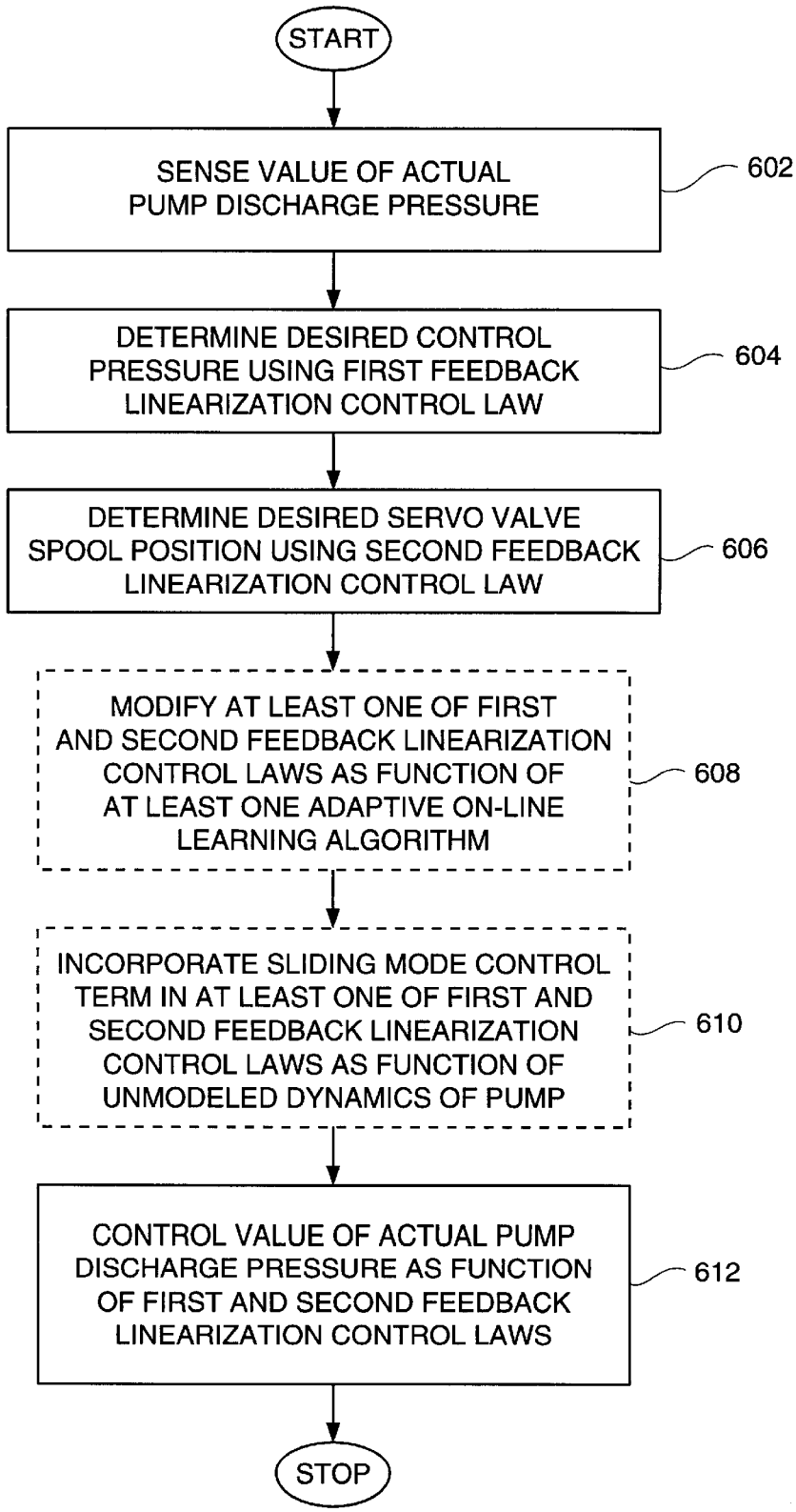
FIG. 6 is a flow diagram illustrating a preferred method of the present invention.

Referring to FIG. 6, a flow diagram illustrating a preferred method of the present invention is shown.

In a first control block 602, the actual pump discharge pressure P is sensed, preferably using the pump discharge pressure sensor 404 shown in FIG. 4. In addition, in the embodiment described with relation to Eq. 1, the angle of inclination of the swashplate $\alpha$ is determined, preferably by use of the swashplate angle sensor 406 shown in FIG. 4.

However, in some high pressure applications, the terms associated with the angle of inclination of the swashplate may be eliminated without adversely affecting the use of the first feedback linearization control law 504, i.e., Eq. 1. Therefore, the swashplate angle sensor 406 is not needed in these applications. A simplified first feedback linearization control law 504 may be represented by:

$$P_{cd} = \frac{P_d}{a_c}\left(a_p\frac{P}{P_d} + \Delta\dot{e} + k_c e\right) \quad \text{(Eq. 6)}$$

where $$e = \frac{\Delta P}{P_d}.$$

In a second control block 604, the desired control pressure $P_{cd}$ is determined using the first feedback linearization control law 504, as explained above with reference to FIG. 5.

In a third control block 606, the desired servo valve spool position $x_v$is determined using the second feedback linearization control law 508, as explained above with reference to FIG. 5.

In an optional fourth control block 608, at least one of the first and second feedback linearization control laws 504,508 is modified as a function of at least one adaptive on-line learning algorithm. An example of use of an adaptive on-line learning algorithm is shown with reference to FIG. 7.

Figure 7:
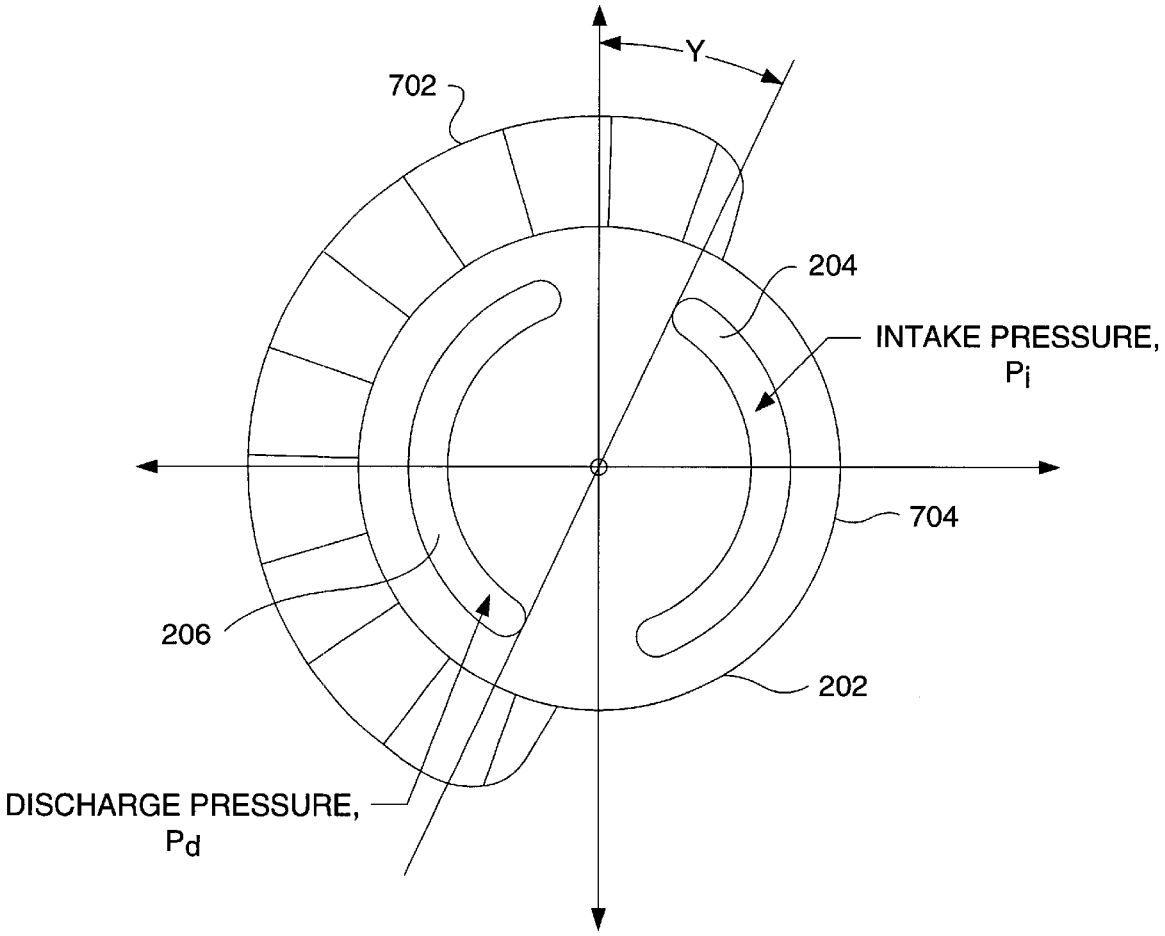
FIG. 7 is a diagrammatic illustration depicting one aspect of the present invention.

In FIG. 7, a valve plate 202 includes an intake port 204 and a discharge port 206. The intake port 204 provides an intake pressure $P_t$, which is a low pressure, at a low pressure region 704. In like manner, the discharge port 206 provides a discharge pressure $P_d$, which is a high pressure, at a high pressure region 702. The transition area from the high pressure region 702 to the low pressure region 704 is a pressure change region commonly known as a swashplate pressure carry over angle $\gamma$. As shown above with respect to Eq. 1, the swashplate pressure carry over angle $\gamma$ is included in the term $a_p$, and thus has an effect on the first feedback linearization control law 504. An adaptive on-line learning algorithm may be used to compensate for the nonlinear effects of $\gamma$. An exemplary on-line learning algorithm may be shown as:

$$\gamma=\phi(P-P_o)^{1/4} \quad \text{(Eq. 7)}$$

and $$\dot{\phi}=-\eta\Delta PP^{1/4}P_d \quad \text{(Eq. 8)}$$

where $\phi$ is a constant determined by factors such as the valve plate geometry of the pump 102, the fluid bulk modulus, the nominal volume of piston chambers in the cylinder block 108, the running speed of the pump 102, and the like. As system conditions change, these factors may change, thus causing changes in $\gamma$. The adaptive on-line learning algorithm, as a result, "learns" these parameters under varying conditions, thus providing a stable, convergent value for $\gamma$ in the first feedback linearization control law 504.

In an optional fifth control block 610, a sliding mode control term is incorporated into at least one of the first and second feedback linearization control laws 504,508 as a function of bounded unmodeled dynamics of the pump 102. Bounded unmodeled dynamics of the pump 102 may include parameters which cannot be determined mathematically, such as, but not limited to, temperature of the hydraulic fluid, frictional forces, pressure errors, and the like. An exemplary equation for sliding mode control is shown as:

$$P_{cd} = \hat{P}_{cd} - \frac{1}{\hat{a}_c}k_{sl}sat\left(\frac{s}{\Phi}\right) \quad \text{(Eq. 9)}$$

where ^ indicates that the term is an estimated term, $k_{s1}$ is a constant that is greater than zero, s is a sliding surface term, and $\Phi$ is the thickness of the boundary layer which determines a performance bound for the system in sliding control. It is understood that other sliding mode equations may be used without deviating from the scope of the present invention.

In a sixth control block 612, the value of the actual pump discharge pressure P is controlled as a function of the first and second feedback linearization control laws 504,508.

INDUSTRIAL APPLICABILITY

As an example of operation of the present invention, a variable displacement hydraulic pump 102 is often used to provide a supply of pressurized hydraulic fluid to various actuators for performing work functions. For example, work implements on earthworking machines are typically powered by hydraulically actuated cylinders. As the hydraulic actuators operate, various conditions create nonlinearities in operation. For example, a work implement on an earthworking machine commonly encounters rocks and other objects which cause an increased demand in pressurized fluid from the pump 102.

It has long been desired to control the pressure of the fluid being provided by a pump 102, but the nonlinearities imposed on the pump make standard control techniques inefficient and unreliable.

The present invention is adapted to control the pressure being delivered by a pump 102 by addressing the nonlinearities and uncertainties associated with real life operations, i.e., by the use of feedback linearization control laws and adaptive algorithms which are targeted toward the actual nonlinear operation of a variable displacement hydraulic pump 102.

Other aspects, objects, and features of the present invention can be obtained from a study of the drawings, the disclosure, and the appended claims.

What is claimed is:

1. A method for controlling a pump discharge pressure of a variable displacement hydraulic pump having a swashplate, and a servo valve for controlling an angle of inclination of the swashplate, including the steps of:

sensing a value of an actual pump discharge pressure;

determining a desired control pressure using a first feedback linearization control law;

determining a desired servo valve spool position using a second feedback linearization control law; and controlling the value of the actual pump discharge pressure as a function of the first and second feedback linearization control laws, wherein the first and second feedback linearization control laws create a first order system response.

2. A method, as set forth in claim 1, further including the step of modifying at least one of the first and second feedback linearization control laws as a function of at least one adaptive on-line learning algorithm.

3. A method, as set forth in claim 2, wherein the adaptive on-line learning algorithm is adapted to monitor a parameter associated with the pump.

4. A method, as set forth in claim 3, wherein the parameter is a pressure carry-over angle of the swashplate as the pump hydraulic pressure transitions from one of the discharge pressure and an intake pressure to an other of the discharge pressure and the intake pressure.

5. A method, as set forth in claim 1, further including the step of incorporating a sliding mode control term in at least one of the first and second feedback linearization control laws as a function of unmodeled dynamics of the pump.

6. A method, as set forth in claim 1, wherein the first feedback control law includes parameters associated with swashplate dynamics, including the angle of inclination of the swashplate.

7. A method, as set forth in claim 6, wherein the first feedback control law is adapted to function without parameters associated with swashplate dynamics, including the angle of inclination of the swashplate, as a function of the pump operating above a predetermined pressure value.

8. An apparatus for controlling a pump discharge pressure of a variable displacement hydraulic pump, comprising:

a swashplate inclinably mounted to the pump;

a servo valve hydraulically connected to the pump for controlling an angle of inclination of the swashplate;

a pump discharge pressure sensor connected to an output port of the pump; and a controller electrically connected to the pump for sensing a value of an actual pump discharge pressure, determining a desired control pressure using a first feedback linearization control law, determining a desired servo valve spool position using a second feedback linearization control law, and controlling the value of the actual pump discharge pressure as a function of the first and second feedback linearization control laws, wherein the first and second feedback linearization control laws create a first order system response.

9. An apparatus, as set forth in claim 8, further including a swashplate angle sensor connected to the swashplate.

10. An apparatus, as set forth in claim 8, further including a control servo in contact with the swashplate and adapted to receive pressurized fluid from the servo valve and responsively control the angle of inclination of the swashplate.

11. An apparatus, as set forth in claim 8, further including a control pressure sensor connected to the control servo for sensing the pressure of the fluid.

12. An apparatus, as set forth in claim 8, wherein the controller is further adapted for modifying at least one of the first and second feedback linearization control laws as a function of at least one adaptive on-line learning algorithm.

13. An apparatus, as set forth in claim 8, wherein the controller is further adapted for incorporating a sliding mode control term in at least one of the first and second feedback linearization control laws as a function of unmodeled dynamics of the pump.

* * * * *